US009423738B1

(12) United States Patent
Koyanagi et al.

(10) Patent No.: US 9,423,738 B1
(45) Date of Patent: Aug. 23, 2016

(54) HEAT GENERATING UNIT, FIXING UNIT, AND IMAGE FORMING APPARATUS HAVING A THERMAL DESTRUCTION ELEMENT

(71) Applicant: FUJI XEROX CO., LTD., Tokyo (JP)

(72) Inventors: Kiyoshi Koyanagi, Kanagawa (JP); Takaaki Sato, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/884,437

(22) Filed: Oct. 15, 2015

(30) Foreign Application Priority Data

Jun. 29, 2015 (JP) ..... 2015-129471

(51) Int. Cl.
*G03G 15/20* (2006.01)

(52) U.S. Cl.
CPC ..... *G03G 15/2053* (2013.01)

(58) Field of Classification Search
CPC ..... G03G 15/2042; G03G 15/2053
USPC ..... 399/69, 329; 219/216
See application file for complete search history.

(56) References Cited

U.S. PATENT DOCUMENTS 7,203,438 B2 * 4/2007 Omata et al. ..... G03G 15/2042 399/69
8,126,383 B2 2/2012 Kagawa
9,235,166 B2 * 1/2016 Shimura ..... G03G 15/2042

FOREIGN PATENT DOCUMENTS

JP 2000260553 A 9/2000
JP 2009244595 A 10/2009

* cited by examiner

*Primary Examiner* — William J Royer
(74) *Attorney, Agent, or Firm* — Oliff PLC

(57) ABSTRACT

A heat generating unit includes a substrate; a heat-generating element that is provided on the substrate and generates heat by receiving electric power; and a thermal destruction element provided on the substrate and connected in series to the heat-generating element, the thermal destruction element having a positive temperature coefficient and causing thermal destruction due to self-heating when heated to a temperature higher than a certain temperature by the heat of the heat-generating element.

5 Claims, 4 Drawing Sheets

HEAT GENERATING UNIT, FIXING UNIT, AND IMAGE FORMING APPARATUS HAVING A THERMAL DESTRUCTION ELEMENT

CROSS-REFERENCE TO RELATED APPLICATIONS

This application is based on and claims priority under 35 USC 119 from Japanese Patent Application No. 2015-129471 filed Jun. 29, 2015.

BACKGROUND (i) Technical Field

The present invention relates to a heat generating unit, a fixing unit, and an image forming apparatus.

(ii) Related Art

In recent years, to achieve an energy-saving and convenient fixing unit and image forming apparatus that require short rise time, there is a demand for reduction in heat capacity of a heating source, such as a heater, and a member to be heated, such as a fixing belt, of a fixing unit and image forming apparatus in which a fixing belt is heated by a heater (heat generating unit) disposed inside an endless fixing belt, through heat conduction.

Such a fixing unit and image forming apparatus having reduced heat capacity tend to cause overheating due to the small heat capacity, so, there is also a demand for a mechanism for preventing fuming and smell due to overheating, occurring when the temperature control becomes defective.

SUMMARY

According to an aspect of the invention, there is provided a heat generating unit including a substrate; a heat-generating element that is provided on the substrate and generates heat by receiving electric power; and a thermal destruction element provided on the substrate and connected in series to the heat-generating element, the thermal destruction element having a positive temperature coefficient and causing thermal destruction due to self-heating when heated to a temperature higher than a certain temperature by the heat of the heat-generating element. Note that "a certain temperature" as used herein is a temperature at which the maximum resistance can be obtained.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

Figure 1:
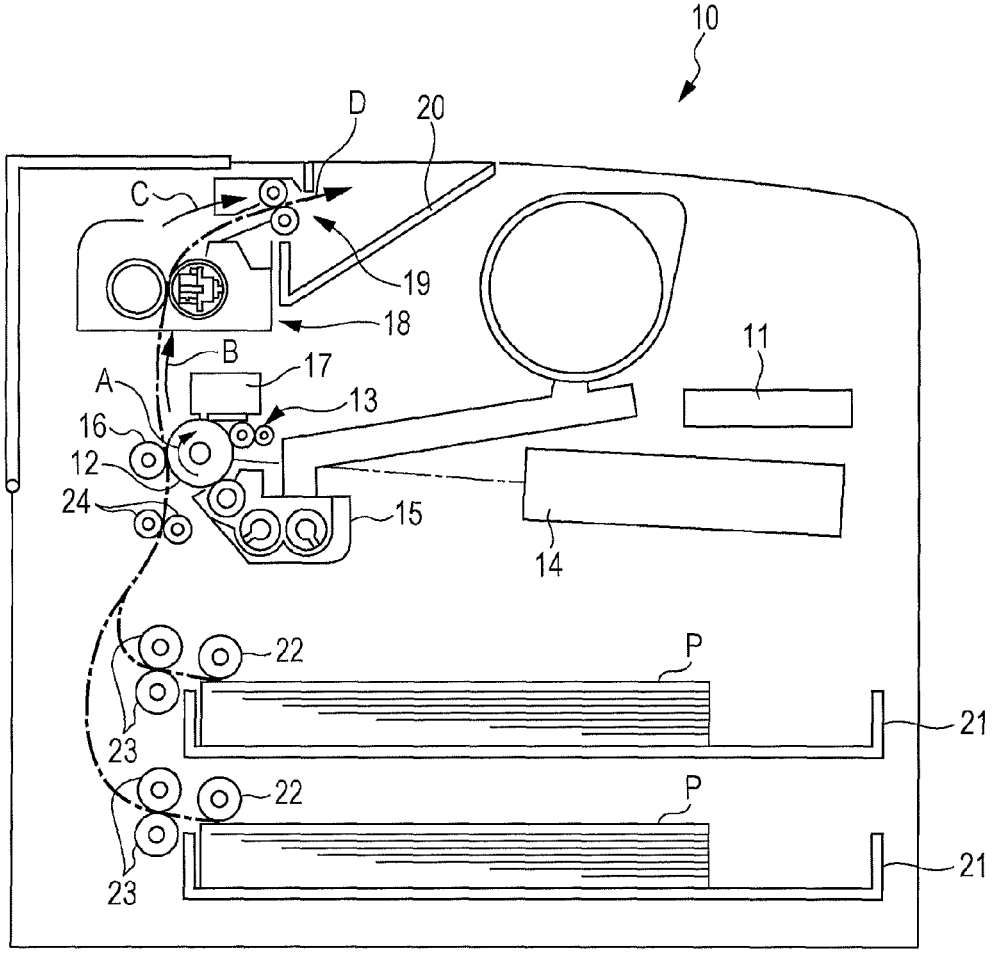
FIG. 1 is a schematic diagram showing the configuration of a printer, serving as an exemplary embodiment of an image forming apparatus of the present invention.

FIG. 1 is a schematic diagram showing the configuration of a printer, serving as an exemplary embodiment of an image forming apparatus of the present invention.

A printer 10 shown in FIG. 1 is a monochrome printer. An image signal representing an image, generated outside the printer 10, is input to the printer 10 via a signal cable or the like (not shown). The printer 10 includes a controller 11 that controls the operations of the components inside the printer 10, and the image signal is input to the controller 11. In the printer 10, image formation based on the image signal is performed under the control of the controller 11.

Sheet trays 21 are provided at the bottom of the printer 10. The sheet trays 21 each accommodate a stack of sheets P. The sheet trays 21 are configured such that they may be freely pulled out for supply of sheets P. The sheet trays 21 may accommodate OHP sheets, plastic paper, envelopes, etc., serving as recording media of the present invention, instead of the paper sheets P. Although the operation of the printer 10 will be described with reference to FIG. 1, in which sheets P are accommodated, the basic operation is the same even when other recording media are accommodated.

A sheet P in one of the sheet trays 21 is sent to standby rollers 24 by a pickup roller 22 and separating rollers 23. At the standby rollers 24, the transportation timing of the sheet P is adjusted, and the sheet P is transported further on.

The printer 10 includes a cylindrical photoconductor 12 that rotates in a direction indicated by arrow A. A charger 13, an exposure unit 14, a developing unit 15, a transfer unit 16, and a photoconductor cleaner 17 are arranged around the photoconductor 12. The photoconductor 12, the charger 13, the exposure unit 14, the developing unit 15, and the transfer unit 16 are collectively an example of a forming unit of the present invention.

The charger 13 charges the surface of the photoconductor 12, and the exposure unit 14 exposes the surface of the photoconductor 12 according to an image signal transmitted from the controller 11, thus forming an electrostatic latent image. The electrostatic latent image is developed by the developing unit 15 into a toner image.

Herein, the standby rollers 24 send the sheet P such that the sheet P reaches a position facing the transfer unit 16, at the time when the toner image on the photoconductor 12 reaches the aforementioned position. Then, the toner image on the photoconductor 12 is transferred to the sheet P sent to the aforementioned position by the transfer unit 16. In this manner, an unfixed toner image is formed on the sheet P.

The sheet P having the unfixed toner image thereon moves further in an arrow B direction and is heated and pressed by a fixing unit 18. Thus, the toner image is fixed onto the sheet P. As a result, an image, formed of a fixed toner image, is formed on the sheet P. The fixing unit 18 corresponds to an exemplary embodiment of a fixing unit of the present invention.

The sheet P that has passed through the fixing unit 18 advances in an arrow C direction toward an output unit 19. The sheet P is further sent in an arrow D direction by the output unit 19 and is output onto a sheet output tray 20.

Figure 2:
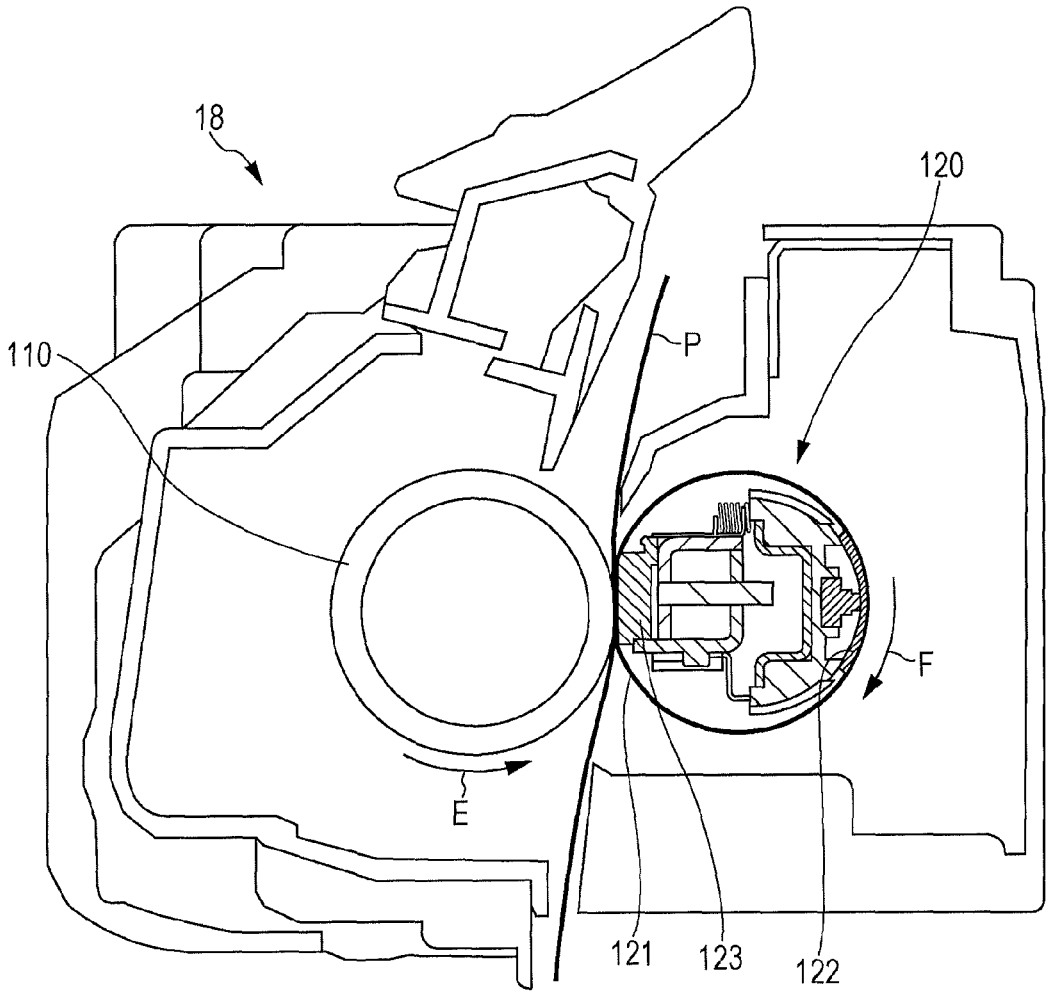
FIG. 2 is a sectional view of a fixing unit.

FIG. 2 is a sectional view of the fixing unit 18.

The fixing unit 18 includes a pressure roller 110 and a heating roller 120.

The pressure roller 110 is formed of a metal core and a rubber layer formed thereon. The pressure roller 110 rotates in an arrow E direction. The pressure roller 110 is an example of a pressure member of the present invention.

The heating roller 120 has an outer circumferential belt 121. A heater 122, a pressure pad 123, etc. are accommodated inside the outer circumferential belt 121. The outer circumferential belt 121 is an example of a revolving member of the present invention, and the heater 122 corresponds to an exemplary embodiment of a heat generating unit of the present invention.

The outer circumferential belt 121 of the heating roller 120 revolves in an arrow F direction while being heated by the heater 122 that makes surface contact with the inner circumferential surface of the outer circumferential belt 121. The outer circumferential belt 121 is urged against the pressure roller 110 by the pressure pad 123. Thus, force and heat are applied to a sheet P passing between the outer circumferential belt 121 and the pressure roller 110.

The heater 122 has an elongated shape extending in a depth direction of FIG. 2 and is connected to a power supply at the ends thereof in the longitudinal direction. The heater 122 generates heat by receiving electric power from the power supply. The heater 122 is curved in the direction in which the outer circumferential belt 121 revolves so as to be in contact with the inner circumference of the outer circumferential belt 121. In order to reduce the rise time, i.e., the time needed for the unheated fixing unit 18 to reach a ready-to-fix state, in this exemplary embodiment, the heater 122 and the outer circumferential belt 121 have small heat capacities. Thus, the heater 122 is configured to suppress overheating when the heat control becomes defective.

Figure 3:
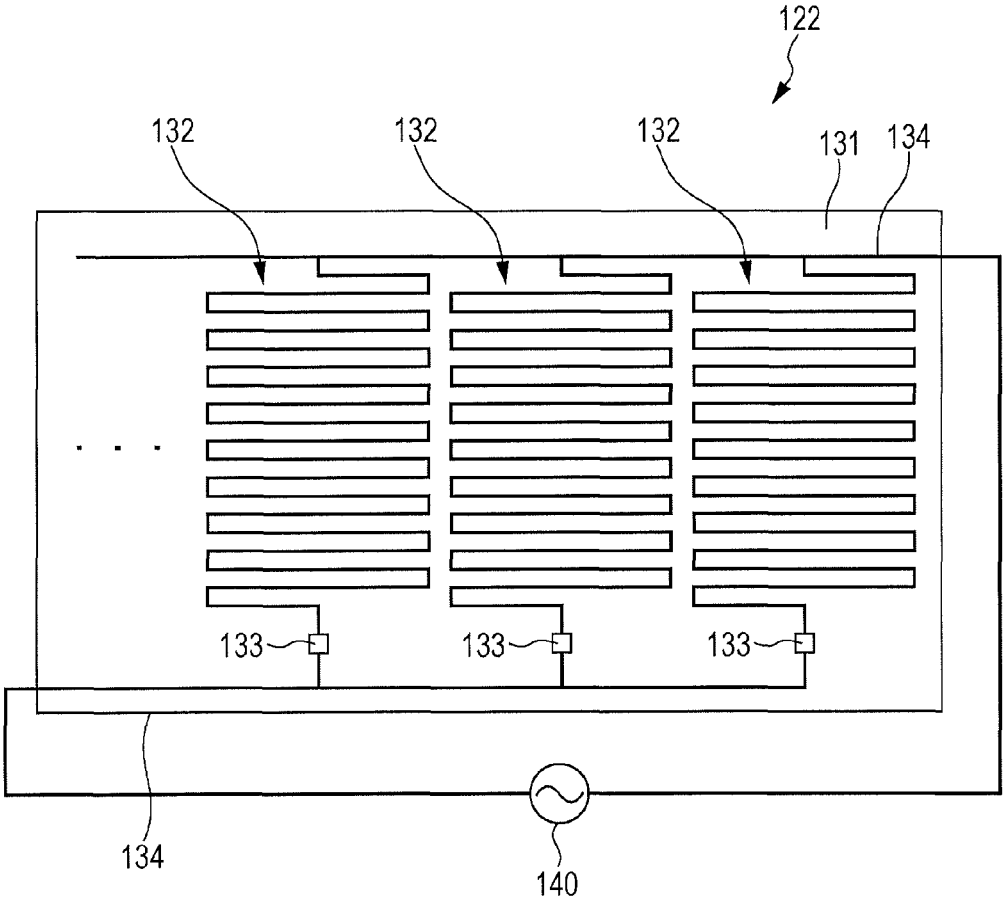
FIG. 3 schematically shows the structure of a heater.

FIG. 3 schematically shows the structure of a heater 122.

The heater 122 has a structure in which multiple pairs of a heating resistor 132 and a PTC element 133, connected in series, are arranged side-by-side on a heater base 131.

Although the heater base 131 has an elongated shape extending in the left-right direction in FIG. 3, for ease of illustration, the length of the heater base 131 in the longitudinal direction is greatly reduced. The heater base 131 is a plate-shaped member that is curved along the inner circumferential surface of the outer circumferential belt 121, as shown in FIG. 2, and is made of, for example, SUS, copper, clad base material, or the like. The heater base 131 is an example of a substrate of the present invention.

The heating resistors 132 are formed of a wiring pattern that is made of, for example, AgPb. Each heating resistor 132 is formed of a wire that forms a series of bends with a width of approximately 15 mm in the longitudinal direction (i.e., the left-right direction in FIG. 3) of the heater base 131 and a length of approximately 20 mm in the transverse direction (i.e., the top-bottom direction in FIG. 3) of the heater base 131. The heating resistors 132 are an example of a heat-generating element of the present invention.

The PTC elements 133 are ceramic elements that are made of, for example, barium titanate mixed with lead. The PTC elements 133 are square flat plates having a thickness of approximately 0.2 mm and a length of each side of approximately 4 mm. The PTC elements 133 are elements having a positive temperature coefficient and are an example of a thermal destruction element of the present invention.

Multiple pairs of the heating resistor 132 and the PTC element 133 are arranged side-by-side in the longitudinal direction (i.e., the left-right direction in FIG. 3) of the heater base 131, and the pairs are connected in parallel by a wire 134. The wire 134 on the heater 122 is connected to a power supply 140 provided outside the heater 122, and the heating resistors 132 generate heat using the electric power supplied from the power supply 140.

In this exemplary embodiment, the PTC elements 133 suppress overheating of the heater 122. A detailed description will be given below.

Figure 4:
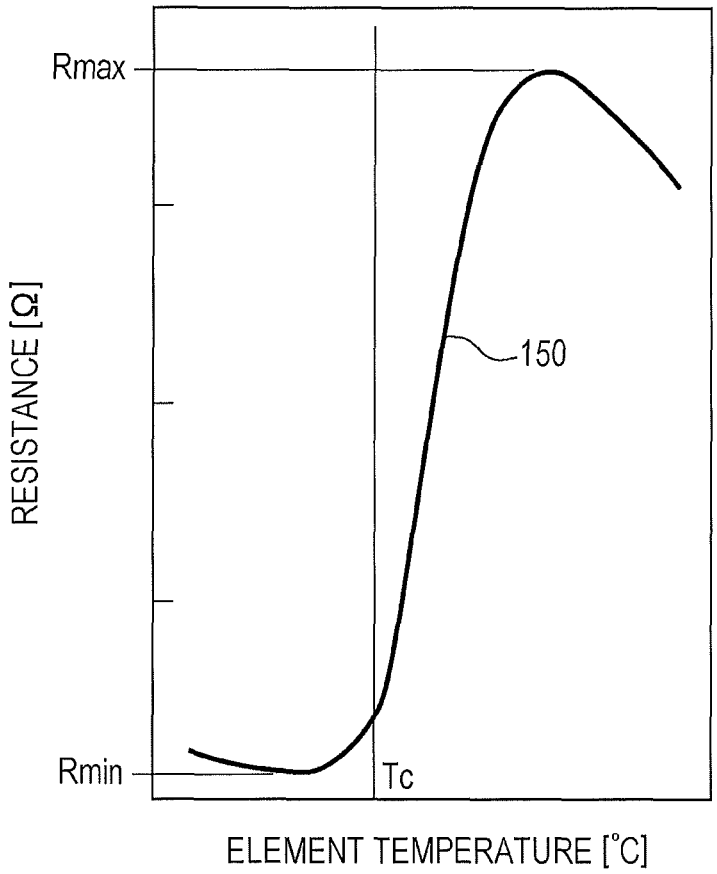
FIG. 4 is a graph showing PTC characteristics of a PTC element.

FIG. 4 is a graph showing the PTC characteristics of the PTC elements 133.

In FIG. 4, the horizontal axis indicates the temperature, and the vertical axis indicates the resistance.

A graph curve 150, which shows the PTC characteristics of the PTC elements 133 employed in this exemplary embodiment, steeply rises at a temperature exceeding a Curie temperature Tc. This shows that the resistance of the PTC elements 133 steeply increases when the temperature of the elements exceeds the Curie temperature Tc. As a result, the ratio of a minimum resistance Rmin at a temperature lower than the Curie temperature Tc to a maximum resistance Rmax at a temperature higher than or equal to the Curie temperature Tc typically exceeds 1:100, and sometimes it reaches 1:100000.

Such ceramic elements are used as the PTC elements 133 shown in FIG. 3, and the Curie temperature Tc is adjusted to a temperature higher than a normal use temperature in the heater 122 and lower than an abnormal temperature at which fuming or smell occurs, by adjusting the amount of lead mixed. Furthermore, although the minimum resistance Rmin and the maximum resistance Rmax are determined according to the size of the PTC elements 133, in this exemplary embodiment, the minimum resistance Rmin is set to less than or equal to one twenty-fifth of the resistance of the heating resistors 132, so that heat generation by the heating resistors 132 is not affected at the normal use temperature.

Because these PTC elements 133 are arranged as shown in FIG. 3, when one of the heating resistors 132 generates excessive heat, the temperature of the PTC element 133 connected thereto exceeds the Curie temperature Tc, and as a result, the resistance of that PTC element 133 steeply increases. Such an increase in resistance causes self-heating of the PTC element 133, leading to thermal destruction of the PTC element 133 due to the thermal shock caused by the self-heating. Because the thermally destructed PTC element 133 breaks the circuit and immediately shuts off the electric power, overheating of the heating resistor 132 connected in series to that PTC element 133 is quickly suppressed. Because this function of the PTC elements 133 is achieved by the multiple pairs of the heating resistor 132 and the PTC element 133 arranged side-by-side in the longitudinal direction (i.e., the left-right direction in FIG. 3) of the heater base 131, local overheating of the heater 122 is also suppressed.

As has been described above, the PTC elements 133 have a flat plate shape, which efficiently causes thermal destruction. A critical temperature difference ΔTc that determines whether or not an infinitely spread flat plate is fractured by thermal shock is calculated from the following expression, on the basis of Young's modulus E, coefficient of linear expansion α, Poisson's ratio ν, fracture strength σmax, coefficient of heat transfer αM, characteristic length D, and thermal conductivity λ.

$$\Delta T_c = \frac{\sigma_{max}(1-\nu)}{\alpha E}\left(1 + \frac{3.25}{\beta} - 0.5\exp\left[\frac{-16}{\beta}\right]\right)\cdot\beta = \frac{\alpha_M D}{2\lambda} \qquad \text{[math. 1]}$$

When a Young's modulus E of 1.15×1011 [N/m], a coefficient of linear expansion α of 12.5×1011 [K−1], a Poisson's ratio ν of 0.3, a fracture strength σmax of 70 [N/m2], a coefficient of heat transfer αM of 1×106 [W/m2K], a characteristic length D of 0.2 [mm], and a thermal conductivity λ of 6 [W/mK], serving as the values of the physical properties, are assigned to the above expression, the resulting critical temperature difference ΔTc is approximately 50K. The above-described maximum resistance Rmax is determined by conducting heat simulation or the like such that self-heating that generates an inside temperature difference of approximately 50K or more occurs, and, according to the thus-determined maximum resistance Rmax, the size of the PTC elements 133 is determined. By determining the maximum resistance Rmax in this way, thermal destruction of the PTC elements 133 is reliably caused, making it possible to reliably suppress overheating of the heating resistors 132. Furthermore, because the thus-determined maximum resistance Rmax is the resistance for causing self-heating, it is much smaller than the resistance for suppressing the current flow by increasing the resistance. Hence, the size and heat capacity of the PTC elements 133 are reduced, enabling thermal destruction to be caused immediately in response to overheating of the heating resistors 132.

In the above-described exemplary embodiment, although a ceramic element composed in large part of barium titanate has been shown as an example thermal destruction element of the present invention, the thermal destruction element of the present invention may be a ceramic element that is composed in large part of a material other than barium titanate or a non-ceramic element, as long as it causes thermal destruction.

Furthermore, in the above-described exemplary embodiment, the curved heater 122 that comes into contact with the inner circumference of the outer circumferential belt 121 has been shown as an exemplary embodiment of the heat generating unit of the present invention, the heat-generating member of the present invention may be one that has a flat-plate shape, one that comes into contact with the outer circumferential of the outer circumferential belt 121 for heating, one that heats a metal tube or the like other than the outer circumferential belt 121, or one that is used for heating in a unit other than the fixing unit 18.

Furthermore, although a monochrome printer has been shown as an example in the above-described exemplary embodiment, the present invention may be applied to a color printer, or it may be applied to a facsimile, a copier, or a multi-function apparatus.

Furthermore, although a device for forming a toner image using an electrophotographic system has been shown as an example in the above-described exemplary embodiment, the forming unit of the present invention may be one that forms a toner image on a recording medium by using a method other than the electrophotographic system.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heat generating unit comprising:

a substrate;

a heat-generating element that is provided on the substrate and generates heat by receiving electric power; and a thermal destruction element provided on the substrate and connected in series to the heat-generating element, the thermal destruction element having a positive temperature coefficient and causing thermal destruction due to self-heating when heated to a temperature higher than a certain temperature by the heat of the heat-generating element, wherein the thermal destruction element is comprised of barium titanate mixed with lead.

2. The heat generating unit according to claim 1, wherein the thermal destruction element has a flat plate shape.

3. The heat generating unit according to claim 1, wherein a plurality of pairs of the heat-generating element and the thermal destruction element are arranged side-by-side on the substrate.

4. A fixing unit comprising:

a heat generating unit including a substrate, a heat-generating element that is provided on the substrate and generates heat by receiving electric power, and a thermal destruction element provided on the substrate and connected in series to the heat-generating element, the thermal destruction element having a positive temperature coefficient and causing thermal destruction due to self-heating when heated to a temperature higher than a certain temperature by the heat of the heat-generating element, wherein the thermal destruction element is comprised of barium titanate mixed with lead;

a belt-shaped revolving member that is brought into contact with the heat generating unit and heated in a middle of a revolving path while revolving along the revolving path; and a pressure member that applies pressure to a recording medium having an unfixed image formed on a surface thereof to fix the image to the recording medium by nipping the recording medium between the pressure member and the revolving member.

5. An image forming apparatus comprising:

a forming unit that forms an unfixed image on a recording medium; and a fixing unit that fixes the image to the recording medium by applying heat and pressure, wherein the fixing unit includes a heat generating unit including a substrate, a heat-generating element that is provided on the substrate and generates heat by receiving electric power, and a thermal destruction element provided on the substrate and connected in series to the heat-generating element, the thermal destruction element having a positive temperature coefficient and causing thermal destruction due to self-heating when heated to a temperature higher than a certain temperature by the heat of the heat-generating element, wherein the thermal destruction element is comprised of barium titanate mixed with lead;

a belt-shaped revolving member that is brought into contact with the heat generating unit and heated in a middle of a revolving path while revolving along the revolving path; and a pressure member that applies pressure to a recording medium having an unfixed image formed on a surface thereof to fix the image to the recording medium by nipping the recording medium between the pressure member and the revolving member.

* * * * *